US005375284A

United States Patent [19]

Deimel et al.

[11] Patent Number: 5,375,284

[45] Date of Patent: Dec. 27, 1994

[54] SWEEPER WITH MOLDED SWEEPING ROLLER HAVING FLEXIBLE SWEEPING STRIPS

[75] Inventors: Helmut Deimel, Nastatten; Rolf G. Schulein, Singhofen, both of Germany

[73] Assignee: Leifheit A.G., Nassau-Lahn, Germany

[21] Appl. No.: 992,602

[22] Filed: Dec. 18, 1992

[30] Foreign Application Priority Data

Dec. 18, 1991 [DE] Germany ..... 4141802

[51] Int. Cl.[5] ..... A47L 11/33

[52] U.S. Cl. ..... 15/41.1; 15/179

[58] Field of Search ..... 15/41.1, 39.5, 179, 15/43, 98, 48, 79.1, 182, 383, 389, 388

[56] References Cited

U.S. PATENT DOCUMENTS

| | | | |
|---|---|---|---|
| 1,307,256 | 3/1921 | Adams | 15/179 |
| 1,395,500 | 11/1921 | Kirby | 15/41.1 |
| 1,507,317 | 9/1924 | Laberge | 15/41.1 |
| 1,514,949 | 11/1924 | Bell et al. | 15/41.1 |
| 1,595,056 | 8/1926 | Boyance et al. | 15/41.1 |
| 1,613,062 | 1/1927 | Snider | 15/41.1 |
| 2,962,740 | 12/1960 | Plantholt | 15/41.1 |
| 4,094,032 | 6/1978 | Liebscher et al. | 15/179 |
| 4,646,380 | 3/1987 | Kobayashi et al. | 15/41.1 |
| 4,809,716 | 3/1989 | Caudill | 15/179 |
| 5,148,569 | 9/1992 | Jailor et al. | 15/41.1 |

FOREIGN PATENT DOCUMENTS

| | | | |
|---|---|---|---|
| 265205 | 4/1988 | European Pat. Off. | 15/41.1 |
| 34 | 1/1991 | Japan | 15/41.1 |
| 457749 | 8/1968 | Switzerland | 15/41.1 |

*Primary Examiner*—David A. Scherbel
*Assistant Examiner*—Gary K. Graham
*Attorney, Agent, or Firm*—Frishauf, Holtz, Goodman & Woodward

[57] ABSTRACT

In a sweeper having a housing 1, in which a sweeping roller 6 driven by impeller wheels 4, 5 is rotatably supported, the sweeping roller comprising a shaft 15 with longitudinally extending sweeping strips 17, the sweeping strips 17 being comprised of a flexible leatherlike plastic material. The sweeping strips 17 are integral with a tube 16 that is slid over onto the shaft 15. Alternatively, the shaft and sweeping strips can be integrally molded as a single part by a two component extrusion process such that the sweeping strips are flexible and the shaft is rigid.

2 Claims, 4 Drawing Sheets

SWEEPER WITH MOLDED SWEEPING ROLLER HAVING FLEXIBLE SWEEPING STRIPS

FIELD OF THE INVENTION

The invention relates to a sweeping machine (hereinafter referred to as a "sweeper") having a housing with a sweeping roller rotatably supported in the housing and driven by impeller wheels, the sweeping roller being located between two dirt collection containers and having a shaft with longitudinally extending sweeping strips on the shaft.

BACKGROUND OF THE INVENTION

In known sweepers of this kind, the sweeping strips each comprise one or two brushes or blades of a flexible, elastic material, such as rubber, plastic, resilient sheet metal, or the like, which are inserted into a rotating shaft. In carpet sweeping, the bristles or sweeping blades are bent or flexed by their contact with the carpet, and as soon as they have left the carpet they bend back again to their original shape by their own elasticity, so that the dirt they had picked up is thrown into one or the other of the collecting containers in the housing. It has now been discovered that optimal sweeping performance is not attained with such sweeping strips, because either the strips are too rigid and then do not bend sufficiently to throw all the dirt they have picked up into the collecting containers, or they are too flexible and then do not penetrate sufficiently far into the carpet. The manufacture of the known sweeping rollers is also complicated and expensive.

It is the object of the present invention to create a sweeper of the above type whose sweeping performance is considerably improved over the prior art, and whose sweeping roller is simpler to manufacture and assemble.

SUMMARY OF THE INVENTION

Briefly, the above object is attained, in a first embodiment of the present invention, by making the flexible sweeping strips integrally with a tube of soft plastic that is slipped or slid over a shaft of rigid material, and wherein the tube is joined directly or indirectly to the shaft in a manner so as to be fixed against rotation relative to the shaft.

In accordance with a second aspect of the present invention, the sweeping strips and the shaft are formed as an integral unit extruded by a two-component extrusion process (i.e., coextrusion) in such a way that the sweeping strips are given a flexible structure and the shaft is given a rigid structure. This substantially simplifies the manufacture of the sweeping roller as compared with the prior art. If a helical course of the sweeping strips is desired, this can easily be accomplished by rotating the extrusion head during the extrusion process to directly mold the sweeping roller with helically extending sweeping strips.

DETAILED DESCRIPTION

Figure 1:
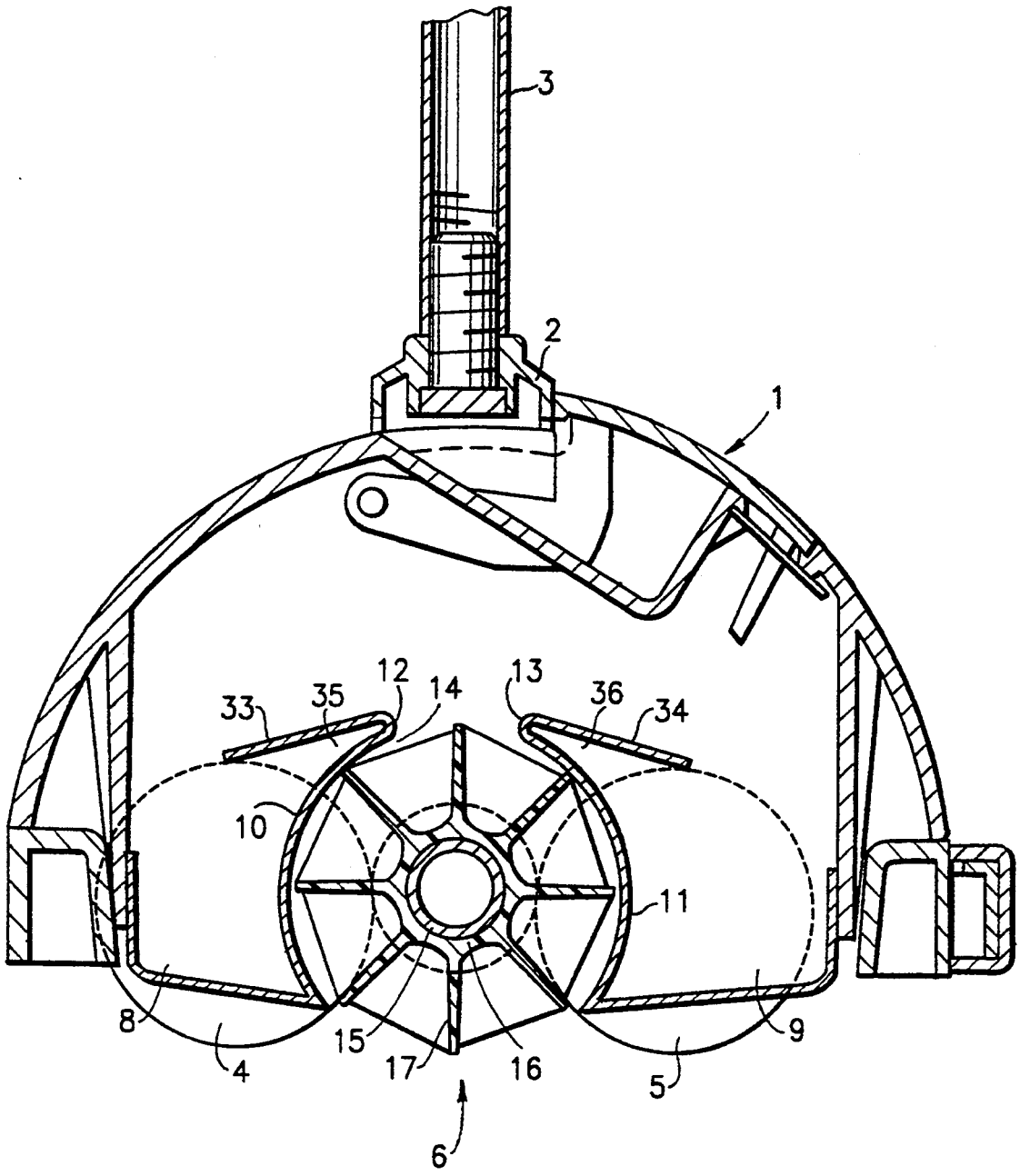
FIG. 1 is a cross section through a sweeper according to the present invention.
Figure 2:
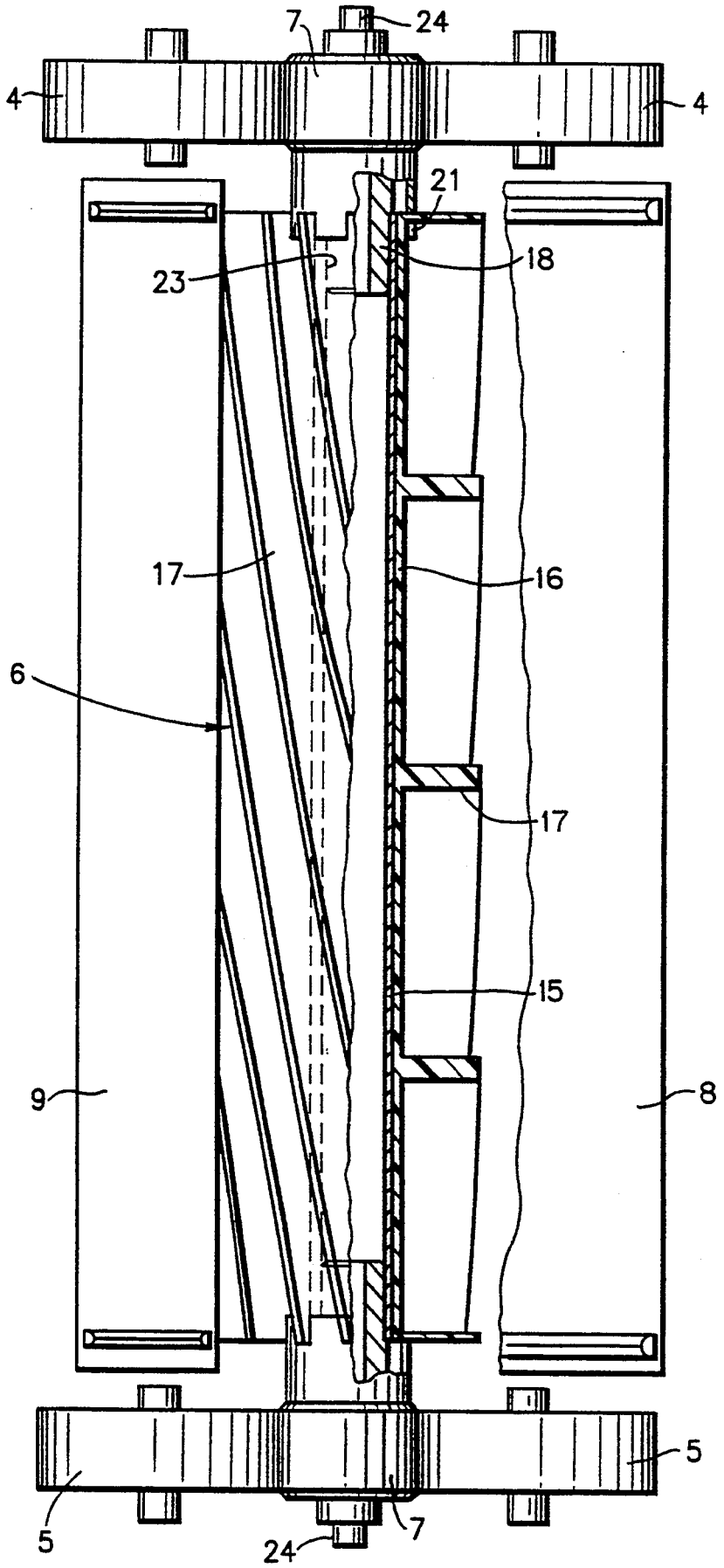
FIG. 2 is a view of the sweeper of FIG. 1 from below, with the housing omitted and showing the sweeping roller in longitudinal section in the upper half.

The sweeper shown in FIGS. 1 and 2 comprises a housing 1, which is pivotably secured to a bracket 2 on which a guide pole or handle 3 is mounted. Supported in the housing 1 are impeller wheel pairs 4 and 5 and a sweeping roller 6, which has driving wheels 7 (FIGS. 2) on its opposite ends that are operatively connected to the pairs 4, 5 of impeller wheels. The driving wheels 7 may be friction wheels which are frictionally engaged with the impeller wheels 4, 5, respectively (see FIG. 2), or the driving wheels 7 may be gears (not shown) which may be engaged with impeller gear wheels 4, 5, as desired. The showing of the wheels 4, 5 and 7 in FIG. 2 is generic to friction wheels and gear wheels. The sweeping roller 6 is located between two dirt collecting containers 8 and 9, whose side walls 10 and 11 extend along the sweeping roller 6 over part of its circumference and whose upper edges 12, 13 define a gap 14, through which the dirt picked up by the sweeping roller 6 is thrown into one or the other collecting container 8, 9, depending on the direction of rotation of sweeping roller 6.

Figure 3:
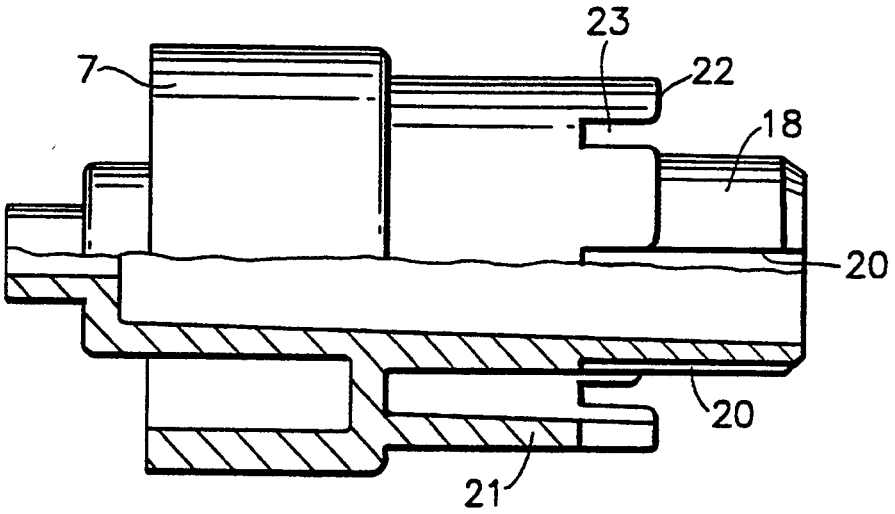
FIG. 3 is a view on a larger scale of a friction wheel intended for mounting on the sweeping roller shaft, with the lower half of the friction wheel shown in longitudinal section.
Figure 4:
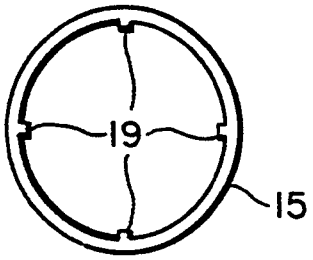
FIG. 4 is an end view of the sweeping roller shaft on which the friction wheel of FIG. 3 is mounted.

The sweeping roller 6 comprises a hollow shaft 15, onto which a tube 16 of soft plastic, with formed-on (i.e., integrally formed) flexible sweeping strips 17 extending radially from the tube 16, is slipped. The sweeping strips 17 are flexible and are "leatherlike" in texture, flexibility, toughness, etc. The shaft 15 and the tube 16 are joined, independently of one another, to the friction wheels 7 in a manner fixed against relative rotation. To that end, as can be seen in FIG. 3, each friction wheel 7 has a central journal 18, onto which the shaft 15 and the tube 16 are slipped. The shaft 15 is provided with ribs 19 pointing inward (FIG. 4), and the journal 18 is provided with corresponding grooves 20, so that the shaft 15 is joined to the friction wheel 7 in a manner fixed against relative rotation by the mounting of the shaft 15 onto the journal 18. The journal 18 is surrounded with clearance by a cylindrical circumferential wall 21, whose end wall 22 is recessed relative to the end wall of the journal 18 and is provided with notches 23 that are engaged by the ends of the sweeping strips 17, thereby establishing a connection, fixed against relative rotation, between the tube 16 and the friction wheel 7. With this embodiment of the sweeping roller 6, its manufacture becomes extremely simple, because the sweeping strips 17 are not separate elements, and thus need not be mounted individually on the shaft. Moreover, because of the mutually independent connection of the shaft 15 and the tube 16 carrying the integrally formed sweeping strips 17 with the friction wheels 7 in a manner fixed against relative rotation, the capability of providing the sweeping strips 17 a helical course is simply achieved, by first introducing a friction wheel 7 with its journal 18 far enough into one end of the tube 16 and shaft 15 that a connection fixed against relative rotation is created between these parts, then the journal 18 of the other friction wheel is inserted into the shaft 15, and after that the other end of the tube is rotated relative to the first end and that journal is thrust all the way into the other end of the shaft 15, until the ends of the sweeping strips 17 engage the notches 23 and the circumferential wall 21 of the journal 18 of the friction wheel. By the previously effected engagement of the ribs 19 (FIG. 4) with the grooves 20, both friction wheels 7 are joined to one another in a manner to prevent relative rotation therebetween, which is made possible by the recessing of the end wall 22 of the circumferential wall 21 relative to the end wall of the journal 18. Upon a rotation of the tube 16 during mounting to the friction wheel 7, not only are the sweeping strips 17 made helical, but a helical course of the edges of the sweeping strips 17 also results, as illustrated in FIG. 2. It has been demonstrated that this further improves the sweeping performance. It will be appreciated that all the parts of the sweeping roller are joined together only by simple plug-type or push-type connections, which makes a fully automatic assembly easier. The complete sweeping roller, with its bearing journals 24, is also simply clipped into corresponding openings in the housing 1, which is made of plastic. If the bearing journals 24 protrude from the housing 1, then they can simultaneously serve to support the bracket 2 of the handle 3.

Figure 5:
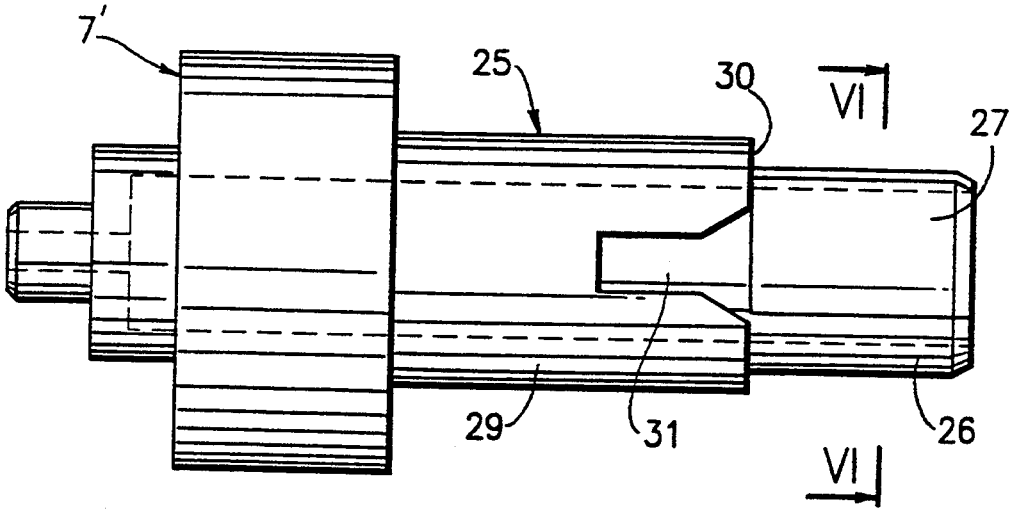
FIG. 5 is a side view of a friction wheel, similar to that of FIG. 3, in a modified form.
Figure 6:
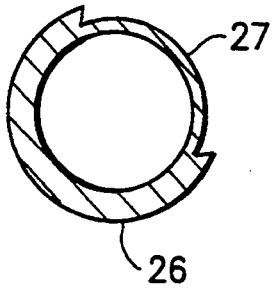
FIG. 6 is a cross section taken along the line 6—6 in FIG. 5.
Figure 7:
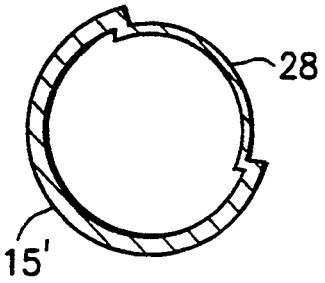
FIG. 7 is a cross section through the sweeping roller shaft on which the friction wheel of FIGS. 5 and 6 is mounted.
Figure 8:
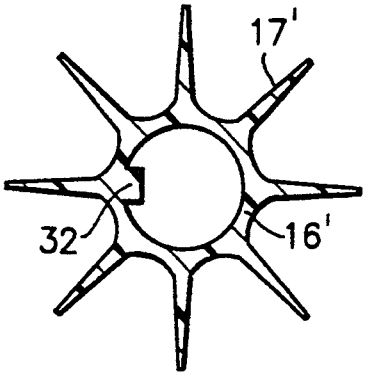
FIG. 8 is an end view of the unit comprising a tube with sweeping strips integrally formed thereon, the tube portion of which is adapted to be slipped or slid over the sweeping roller shaft of FIG. 7 and which is adapted to be joined to the friction wheel of FIG. 5 in a manner fixed against relative rotation therewith.

FIGS. 5–7 show a modification of the connection, fixed against relative rotation, between a friction wheel 7', the shaft 15' and the tube 16' with the sweeping strips 17'. The hub of the friction wheel 7' has a central journal 25 with a first segment 26, whose outside diameter is equivalent to the inside diameter of the shaft 15' and which is provided on its circumference with a recess 27 extending over a relatively large angular region The hollow shaft 15', which over a corresponding angular region has a protrusion 28 directed radially inward, is slipped over this segment 26, whereupon a connection therebetween in a manner fixed against relative rotation is established between these parts. A second segment 29 of the journal 25, whose diameter is equivalent to the inside diameter of the tube 16', is provided with a groove 31, which begins at its end face 30 and is engaged by a radially inwardly directed protrusion 32 of the tube 16' that is preferably formed by a rib extending over the entire length of the tube 16'. The sweeping strips 17' are made helical by the angular offset of the two friction wheels 7' by about 180° relative to one another.

As mentioned at the outset, the sweeping roller 6 is located between two dirt collecting containers 8 and 9 with side walls 10, 11, whose upper edges 12, 13 define a gap 14 through which the dirt picked by the sweeping strips 17 is thrown into one collecting container or the other. For storage, the sweeper is normally suspended from its guide pole or handle 3, whereupon the housing 1 tips or pivots into a vertical position. To prevent dirt from escaping through the gap 14 from the collecting container, which in the storage position is then located at the top, a covering wall 33, 34 (FIG. 1) is connected to the upper edge 12, 13 of each side wall 10, 11, respectively. The covering wall extends at a tangent to the sweeping roller 6 in the applicable collecting container and forms an acute angle (i.e., around 30°) with the associated side wall. The dirt then collects in the nip 35 or 36 (see FIG. 1) thus formed.

In a modification of the exemplary embodiment shown, the sweeping strips may form an integral unit with the shaft. Such a unit is manufactured by the two-component extrusion process (i.e., coextrusion) in such a way that the sweeping strips are given their leather-like or flexible structural characteristic and the shaft is given a rigid structure. If a helical course of the sweeping strips is desired in this case as well, this can be done by rotating the extruder head during the extrusion process to directly mold the sweeping roller with helically extending sweeping strips.

Optimal sweeping performance has been achieved with sweeping strips made of a soft plastic (polyvinylchloride (PVC), for example) having a Shore hardness A of about 60 to about 80, and preferably from about 60 to about 70. Thermoplastic elastomers, such as PVC, are the preferred materials for sweeping strips 17 and tube 16. Preferably, when made of PVC, the sweeping strips 17 have a thickness of from about 0.8 to about 1.2 mm, and are quite flexible. When made using coextrusion, only the strips 17 are quite flexible.

It has surprisingly been discovered that such flexible, leatherlike soft plastic sweeping strips 17 as described above have precisely the desired degree of flexibility that the sweeping strips, upon contacting the carpet, are bent or flexed far enough that they snap back again (by their own resiliency) upon leaving the carpet so fast that virtually all the dirt they have picked up is thrown into the collecting container. On the other hand, the sweeping strips 17 of the present invention are stiff enough to penetrate sufficiently deep into the carpet. The sweeping action is further improved if the edges of the sweeping strips 17 are wavy and/or have a helical course, as described above. The manufacture of the sweeping roller is simplified substantially by making the sweeping strips 17 integral with the tube 16 which is slipped or slid onto the rigid shaft 15 and joined directly or indirectly to the shaft 15 in a manner fixed against relative rotation, as shown in FIGS. 1–4. A helical course or shape of the sweeping strips 17 (along the axis of the shaft 15) can be attained especially simply by twisting the ends of the tubes 16 (which are of flexible plastic) relative to one another upon installation and then joining them directly or indirectly to the shaft 15 in a manner fixed against relative rotation with the shaft 15.

If the sweeping roller 6 has friction driving wheels (not shown) or gear wheels 7 on its ends that are operatively connected to the impeller wheels 4, 5, then the joining of the ends of the tube 16 to the shaft 15 in a manner fixed against relative rotation can be effected via the hubs of these wheels, which are joined in the same manner, fixed against relative rotation, to the shaft and which have notches on their ends facing one another, the notches being engaged by protrusions on the ends of the tube. These protrusions may be formed by the ends of the sweeping strips.

Preferably, as shown in the drawings and as described above, the shaft 16 is hollow and is provided on its ends with at least one protrusion directed inward, and the hubs of the driving wheels 7 have a central journal with a first segment onto which the applicable end of the shaft can be mounted and which has a recess for receiving the protrusion. The hubs have a second segment of larger diameter, onto which the tube 16 provided with the sweeping strips 17 can be slipped or slid and which is provided on its outer circumference with at least one recess for receiving an inwardly directed protrusion on the applicable end of the tube 16.

Aside from the problem of reliable sweeping of the dirt picked up by the sweeping strips 17 into one or the other collecting container 8, 9, as discussed above, sweepers of the generic type to which the present invention pertains also have the problem of reliably preventing the collected dirt from falling out of the collecting containers when the sweeper is hung up by its pole or handle 3, in the usual manner, in which case the housing 1 of the sweeper tips into a vertical position. To solve this problem, the present invention provides, as discussed above, covering walls 35, 36 on the upper edges of the side walls of the dirt collecting container 8, 9, which extend longitudinally of the sweeping roller and define a gap through which the dirt is thrown into one or the other collecting container 8, 9 depending on the direction of rotation of the sweeping roller 6. The covering walls extend preferably at a tangent to the sweeping roller 6 into the interior of the respective collecting container. When the sweeper of the present invention is hung up, the dirt is retained in the collecting container by the covering wall. The covering wall and the side wall preferably form an acute angle, so that when the sweeper is hung up, the dirt collects in the nip formed as a result, rather than being able to escape through the gap 14 between the upper edges of the side walls.

Various changes and modifications may be made, and features described in connection with any one of the embodiments may be used with any of the others, within the scope of the inventive concept.

What is claimed is:

1. A sweeper comprising:

a housing (1);

a guide pole (3) pivotally mounted to said housing;

a sweeping roller (6) rotatably mounted in said housing;

impeller wheels (4, 5) rotatably supported in said housing;

driving wheels (7, 7') at opposite end portions of said sweeping roller (6), said driving wheels being coupled to said impeller wheels (4, 5), for rotatably driving said sweeping roller (6);

two collecting containers (8, 9) mounted in said housing, said sweeping roller (6) being mounted in said housing between said two collecting containers (8, 9);

said sweeping roller (6) including:

a substantially rigid hollow shaft (15, 15');

a tube member (16, 16') having longitudinally extending sweeping strips (17, 17') integrally formed with and extending radially from said tube member (16, 16'), said tube member and said sweeping strips being formed of a soft flexible plastic material, and said tube member (16, 16') being slideably mounted onto said hollow shaft (15, 15') so as to extend axially over said hollow shaft; and means coupling said tube member to said hollow shaft for preventing relative rotation between said hollow shaft and said tube member;

said driving wheels (7, 7') being coupled to said hollow shaft (15, 15') such that said driving wheels are fixed against relative rotation with respect to said hollow shaft, and said driving wheels having hubs on ends thereof, said hubs facing one another, and said hubs each having at least one notch (23, 31) therein which is engaged by a protrusion (32) provided on respective ends of said tube member (16, 16') for fixing said tube member to said driving wheels such that when said driving wheels are rotated, said hollow shaft and said tube member are also rotated therewith; and said hollow shaft (15) having on opposite ends thereof at least one radially inwardly directed protrusion (19);

said hubs of said driving wheels (7) each having a substantially central journal (18) on which one respective end of said hollow shaft (15) is mounted and which is provided with a recess (20) for receiving said inwardly directed protrusion (19) of said hollow shaft; and said hubs further having a cylindrical circumferential wall (21) which surrounds said substantially central journal (18) with a clearance, and wherein notches are provided in an end wall portion (22) of said cylindrical circumferential wall (21) for receiving ends of said sweeping strips (17).

2. A sweeper comprising:

a housing (1);

a guide pole (3) pivotally mounted to said housing;

a sweeping roller (6) rotatably mounted in said housing;

impeller wheels (4, 5) rotatably supported in said housing; and driving wheels (7, 7') at opposite end portions of said sweeping roller (6), said driving wheels being coupled to said impeller wheels (4, 5), for rotatably driving said sweeping roller (6);

two collecting containers (8, 9) mounted in said housing, said sweeping roller (6) being mounted in said housing between said two collecting containers (8, 9);

said sweeping roller (6) including:

a substantially rigid hollow shaft (15, 15');

a tube member (16, 16') having longitudinally extending sweeping strips (17, 17') integrally formed with and extending radially from said tube member (16, 16');

said tube member and said sweeping strips being formed of a soft flexible plastic material, and said tube member (16, 16') being slideably mounted onto said hollow shaft (15, 15') so as to extend axially over said hollow shaft;

means coupling said tube member to said hollow shaft for preventing relative rotation between said hollow shaft and said tube member;

said driving wheels (7, 7') being coupled to said hollow shaft (15, 15') such that said driving wheels are fixed against relative rotation with respect to said hollow shaft, and said driving wheels having hubs on ends thereof, said hubs facing one another, and said hubs each having at least one notch (23, therein which is engaged by a protrusion (32) provided on respective ends of said tube member (16, 16') for fixing said tube member to said driving wheels such that when said driving wheels are rotated, said hollow shaft and said tube member are also rotated therewith; and said hollow shaft (15') having on opposite ends thereof at least one radially inwardly directed protrusion (28); and said hubs of said driving wheels (7') each having a substantially central journal (25) having a first segment (26) on which one end of said hollow shaft (15) is mounted and which has a recess (27) therein for receiving said inwardly directed protrusion (28) of said hollow shaft, said substantially central journal having a second segment (29) of larger diameter on which said tube member (16') provided with said sweeping strips (17') is mounted, said hollow shaft having on its outside circumference at least one recess (31) for receiving a radially inwardly directed protrusion (32) on a respective end of said tube member.

* * * * *